US006971560B1

(12) United States Patent
Healy et al.

(10) Patent No.: US 6,971,560 B1
(45) Date of Patent: Dec. 6, 2005

(54) FRICTION RESISTANT TIME DELAY ACTUATOR ASSEMBLY FOR AEROSOL CONTAINERS

(75) Inventors: Brian E. Healy, Hartland, WI (US); Nathan R. Westphal, Racine, WI (US); John C. Mehnert, Madison, WI (US)

(73) Assignee: S. C. Johnson & Son, Inc., Racine, WI (US)

( * ) Notice: Subject to any disclaimer, the term of this patent is extended or adjusted under 35 U.S.C. 154(b) by 0 days.

(21) Appl. No.: 10/845,692

(22) Filed: May 14, 2004

(51) Int. Cl.[7] ..... G04C 23/00

(52) U.S. Cl. ..... 222/645; 222/649; 222/402.2; 222/402.13

(58) Field of Search ..... 222/644–649, 222/1, 182, 402.2, 402.13, 402.11, 402.25

(56) References Cited

U.S. PATENT DOCUMENTS 2,297,690 A 10/1942 Nitardy
2,371,293 A 3/1945 Hoof
3,519,171 A * 7/1970 Kinnavy ..... 222/394
3,666,144 A * 5/1972 Winder ..... 222/646
4,407,435 A * 10/1983 Harmon ..... 222/481
4,823,986 A 4/1989 Pearce, III
4,887,744 A * 12/1989 Williams ..... 222/402.1
5,068,099 A 11/1991 Sramek
5,702,036 A * 12/1997 Ferrara, Jr. ..... 222/402.13
5,791,524 A 8/1998 Demarest
6,006,957 A 12/1999 Kunesh
6,517,009 B2 * 2/2003 Yahav ..... 239/70
6,612,464 B2 * 9/2003 Petterson et al. ..... 222/1
6,688,492 B2 * 2/2004 Jaworski et al. ..... 222/1
6,695,227 B1 2/2004 Hayashi et al.

* cited by examiner

*Primary Examiner*—Frederick Nicolas

(57) ABSTRACT

An actuator assembly is disclosed which can dispense chemicals, such as insect control ingredients, from an aerosol container. The actuator assembly is mountable to the aerosol container and includes a solid plug that, upon initial activation, will be caused by the pressure of the chemical in the aerosol container to move to an unsealed position. Movement of the plug is retarded by a frictional engagement of the plug with an associated passage/conduit. The device can be manually activated, but is designed so that thereafter it does not need to be manually held open. The consumer has time to leave the room before spraying begins, and does not need to be present in the room before spraying has finished.

16 Claims, 6 Drawing Sheets

FRICTION RESISTANT TIME DELAY ACTUATOR ASSEMBLY FOR AEROSOL CONTAINERS

CROSS-REFERENCE TO RELATED APPLICATIONS

Not applicable

STATEMENT REGARDING FEDERALLY SPONSORED RESEARCH/DEVELOPMENT

Not applicable

BACKGROUND OF THE INVENTION

The present invention relates to aerosol dispensing devices, and in particular to actuator assemblies that provide a friction-regulated time delay between the initial activation of the devices and the actual release of the aerosol contents to the ambient environment.

Aerosol containers dispense a variety of ingredients. One or more chemicals to be dispensed are usually mixed in a solvent and, in any event, typically are mixed with a propellant. Typical propellants are compressed air or other compressed gases, carbon dioxide, a selected hydrocarbon gas, or mixtures of hydrocarbon gases, such as a propane/butane mix. For convenience, materials being dispensed will be referred to herein merely as "chemical(s)," regardless of their chemical nature or intended function. Without limitation, chemicals can include actives such as insect control agents (e.g. a repellent, insecticide, or growth regulator), fragrances, sanitizers, cleaners, waxes or other surface treatments, and/or deodorizers.

The active/propellant mixture is stored under pressure in the aerosol container. The mixture is then sprayed out of the container by pushing down or sideways on an activator button at the top of the container that controls a release valve mounted at the top end of the container. The sprayed active may exit in an emulsion state, single phase, multiple phase, and/or be partially gaseous.

The aerosol container contents can be released via manual pressure (for as long as such manual pressure is provided). Alternatively, the control valve can be switched to an on position such that essentially the entire contents of the can are automatically dispersed in a single continuous, albeit elongated, burst (e.g. total release foggers), or by intermediate spaced bursts (e.g. automatic dosing systems).

U.S. Pat. No. 4,823,986 discloses a system for providing a time delay between the initial activation and the actual release of the contents. This provides the operator time to leave the dispense area to avoid being exposed to the chemicals. This is especially desirable when the active being dispensed is an insecticidal fumigant. See also U.S. Pat. Nos. 2,244,302 and 2,759,768 for other time delay systems.

However, such prior art time delay systems often rely on the pressure of the container to burst a thin membrane, or rely on a chemical reaction between the chemicals in the container and a seal which causes a degradation and ultimate rupturing of the seal. The former are difficult to reliably manufacture so as to provide a consistent delay. The latter also have this problem and may provide constraints on the formulation of the chemical. Certain other prior art systems cost so much as to render them impractical, and/or have other deficiencies.

Hence, a need remains to provide improved, inexpensive, and reliable time delay systems for such purposes.

BRIEF SUMMARY OF THE INVENTION

The invention provides an actuator assembly suitable for dispensing a chemical from an aerosol container to ambient environment, with a time delay after (preferably immediately after) initial activation of the actuator assembly. The assembly has a release valve linkable to the aerosol container for controlling the release of the chemical to the environment, an actuator adapted to mount on the aerosol container and be operably connected to the release valve for at least initially activating the release valve, and a time delay system associated with the release valve which comprises a movable solid plug and a wall contacting the plug. By solid plug, we mean a plug that is made of a material with a Shore OO durometer of at least 30. Such a material is harder than gelatinous and thixotropic substances. Preferably, the solid plug is made of a material with a Shore OO durometer of at least 35, at least 40, at least 50, at least 60, at least 70, at least 80, or at least 90. Shore A scale is used to measure harder materials and Shore D scale is used to measure yet even harder materials. For example, 70, 80 and 90 Shore OO durometer correspond approximately to 20, 30 and 50 Shore A durometer, respectively. Therefore, materials with at least 50, at least 60, at least 70, at least 80, or at least 90 Shore A durometer are also suitable materials for making the plug of the present invention.

Upon initial activation of the actuator assembly the plug will be caused to move from a sealing position to an unsealing position, with friction between the plug and wall regulating the speed of such movement so as to thereby create the time delay. The pressure in the aerosol container will cause such movement. It is noted that since the solid plug is made of a material sufficiently hard, it will not rupture or substantially deform under the pressure from the aerosol container.

In one preferred form the wall is an exterior wall of a conduit end and the plug is in the form of a cap mountable outside and against the end. The plug can be linked by a flexible tether to the conduit.

Where the wall is an interior wall of a passage and the plug is in the form of a ball positioned inside the passage to move along the passage, the plug can frictionally engage the wall as it moves along the passage, at least initially in a sealing fashion. Preferred materials are metals and plastics for the wall and ball, with one preferably being made of a soft flexible material and the other being of a more rigid material.

The passage can alternatively be provided with two enlarged sections. The first is a enlarged rest area where the ball can reside during storage of the device. The second is a catching area where the ball moves to once it has cleared a sealing portion of the passage.

The present invention is most suitable for use with insect fogger products. Upon initial activation the actuator assembly can dispense essentially all the chemical in the container without further outside manual intervention, in a continuous single burst, albeit with an initial time delay. Alternatively, the valve can be used with automatic intermittent sprayers where the dispensing is still essentially total, but takes place with multiple separated bursts.

Where the wall is part of a passage, the plug and wall can be configured such that the plug can move from a first position in which the plug blocks dispensing of the chemical from the container to a second position in which the plug is retained by the actuator assembly but does not block dispensing of the chemical from the container.

In another aspect the invention provides methods for using such assemblies.

In using the present invention a consumer will first manually initiate the actuator system. However, this will not immediately begin spraying. Rather, this will place the can contents in communication with the time delay system. The pressure of the can contents will then begin to act against the plug to begin moving it. However, the plug's movement will initially be retarded by frictional contact between the plug and an associated wall. While they are in such contact the container will remain sealed off from the ambient environment. Hence, no dispensing will occur for a defined time period.

However when the plug has moved sufficiently, sealing contact between the plug and wall will end, permitting container contents to move past the plug to an outlet, thereby dispensing the chemical. The plug is prevented from popping off in an unpredictable manner by providing a tethering system or a catching area.

An enlarged rest position can be provided where the plug can be internally positioned with minimal risk that it will be mechanically frozen during storage. In such an assembly the first burst of pressure will drive the plug into a restricted portion of the passage, beginning the time delay.

Very low density polyethylene conduits and steel plug balls are a preferred set of materials for practicing the invention. However, numerous materials and combinations of materials should be suitable for use with the invention. By selecting material attributes and length of conduits particular time delays can be designed as desired. See e.g. FIG. 9 showing the effect of changes in ball diameter when using a one inch long vinyl tube with an inside diameter of 3/16 inch.

The time delay system of the present invention is inexpensive to produce, and suitable to be used with a variety of existing total release valves. It has reliable time delay characteristics.

The foregoing and other advantages of the invention will become apparent from the following description. In the following description reference is made to the accompanying drawings which form a part thereof, and in which there is shown by way of illustration preferred embodiments of the invention. Such embodiments do not represent the full scope of the invention. Reference should therefore be made to the claims herein for interpreting the scope of the invention.

DETAILED DESCRIPTION OF THE PREFERRED EMBODIMENTS

U.S. Pat. No. 5,791,524 disclosed a prior art total release actuator and its use with an aerosol container. The disclosure of U.S. Pat. No. 5,791,524, and all other patents referred to herein, are hereby incorporated by reference as if fully set forth herein.

Figure 1:
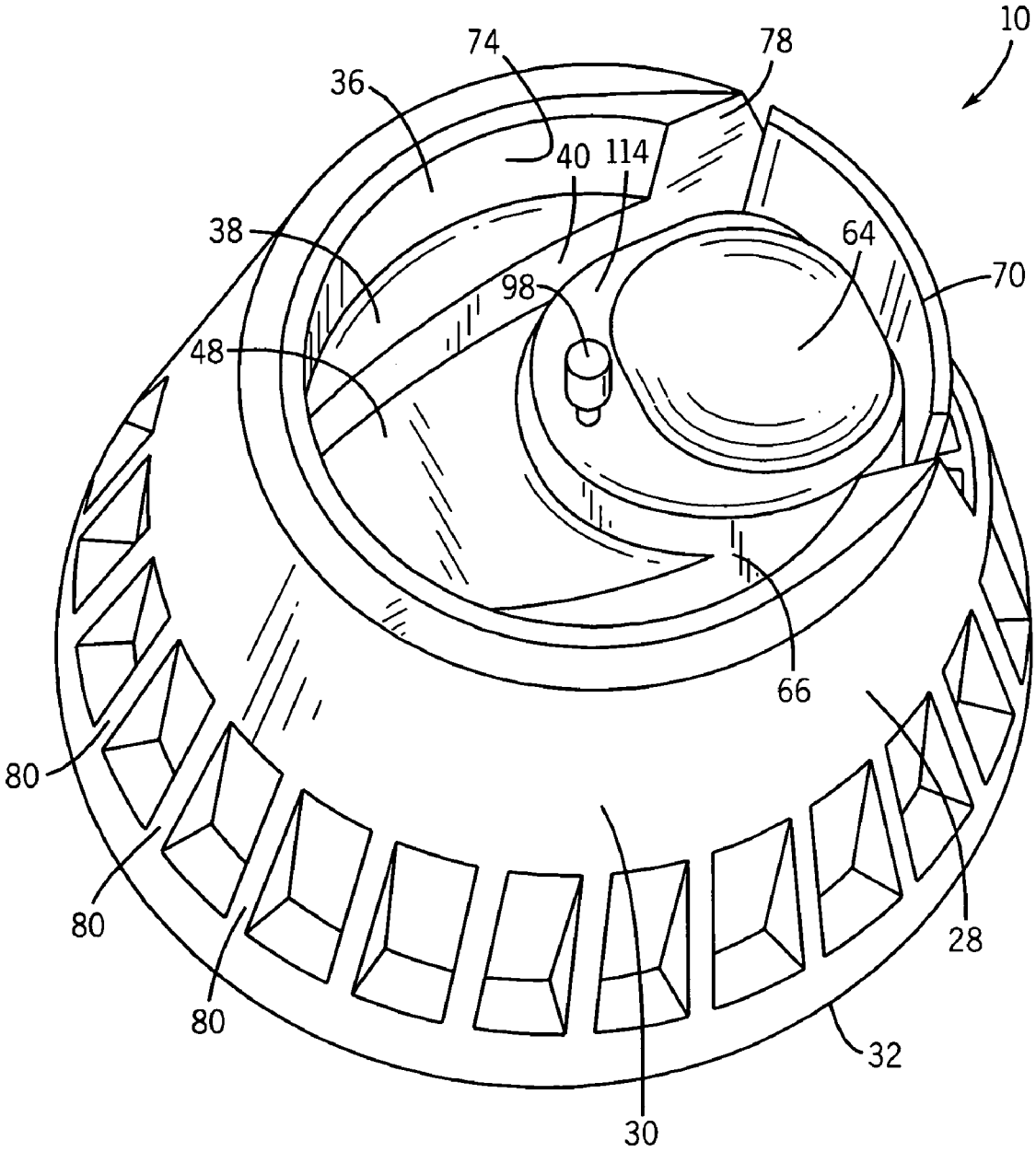
FIG. 1 is a front perspective view of an aerosol can cap embodying the present invention, the view being taken from above and to the right.

FIG. 1 shows a preferred embodiment of an actuator assembly of the present invention, as embodied in an aerosol actuator cap. Assembly 10 is configured to be useful with conventional aerosol containers, such as the one partially shown in phantom lines at 12 in FIG. 4. Aerosol container 12 may include the usual cylindrical container wall 14 that is closed at its upper margin by a dome 16. The joint between the upper margin of the container wall 14 and the dome 16 is the usual container chime 18.

A valve cup 20 is located at the center of the dome 16 and is joined to the dome by a joint in the form of a valve cup rim 22. A release valve 24 is located at the center of the valve cup 20. The release valve 24 has an upwardly extending valve stem 26, through which the contents of the container may be expelled. The valve 24 may be operable by moving the associated valve stem 26 directly downwardly, or by tilting it sideways.

The body 28 is adapted to attach to the aerosol container 12. The actuator body 28 has a peripheral skirt 30. The lower margin of the peripheral skirt 30 defines a skirt rim 32. The skirt rim 32 is adapted to fit over and engage the chime 18. Preferably, the skirt rim 32 actually attaches to the chime 18 by means of undercuts 34 that extend inwardly from the interior surface of the skirt rim. In assembly, the actuator body 28 is forced downwardly onto the chime 18, the undercuts 34 slipping over the chime to snap under it, fastening the actuator body to the chime.

Figure 2:
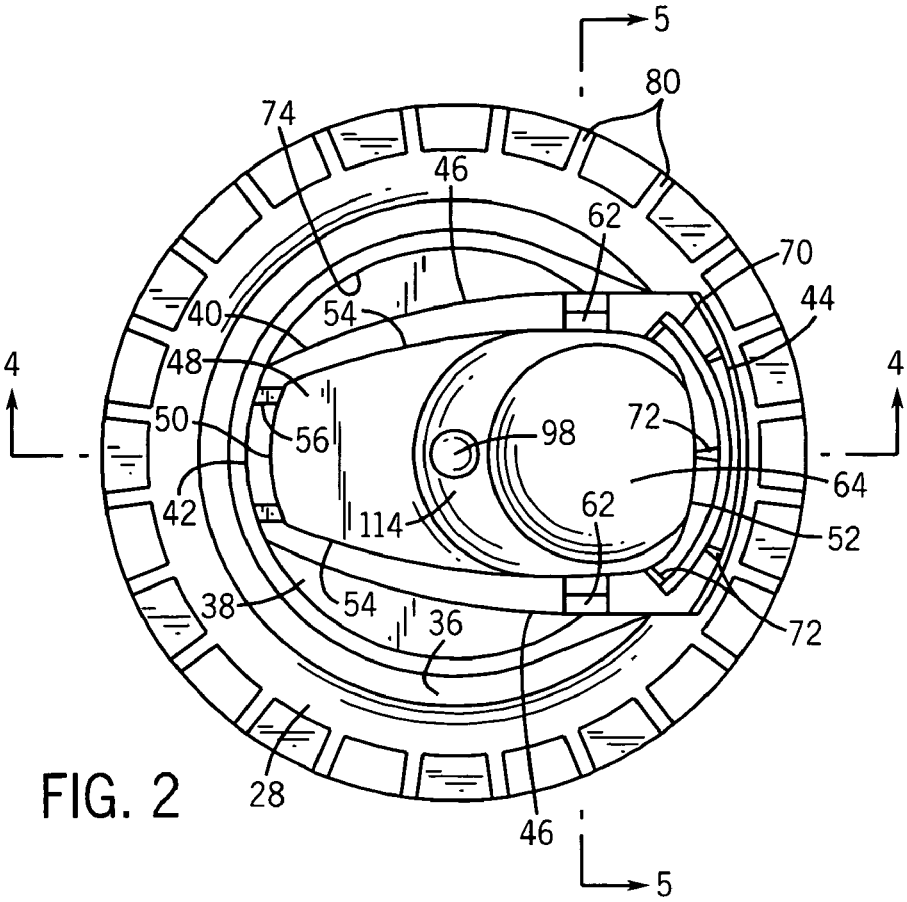
FIG. 2 is a top plan view of the actuator cap of FIG. 1.

The actuator body 28 also has a central well 36. The central well 36 preferably has a generally horizontal well floor 38, as best shown in FIGS. 1 and 2. The central well 36 has a trigger port 40, preferably located in and extending through the well floor 38. The trigger port 40 has a front end 42, a back end 44, and opposed sides 46.

The time delay actuator assembly 10 of the invention includes a longitudinally extended trigger 48. The trigger 48 has a front end 50, a back end 52, sides 54 and a conduit well 110. The conduit well houses conduit 92 and is formed by side wall 112 extended downwardly from top portion 114 of the trigger 48. The trigger 48 is attached at one of its front and back ends 50,52 to the corresponding front or back end 42,44 of the trigger port 40. This attachment is by means of a hinge 56, which most conveniently is a living hinge that is unitarily molded with the remaining parts of the time delay actuator assembly 10.

Preferably, the trigger 48 is attached at its front end 50 to the front end 42 of the trigger port 40, as is shown in the figures, to allow the trigger's back end 52 to swing downwardly when the trigger is depressed. In any event, the hinge 56 allows the end of the trigger 48 that is remote from the hinge to swing downwardly when the trigger is depressed. The trigger 48 extends from the hinge 56 across the valve stem 26 when the actuator is in place on the aerosol container 12. This relationship is best shown in FIG. 4.

Figure 3:
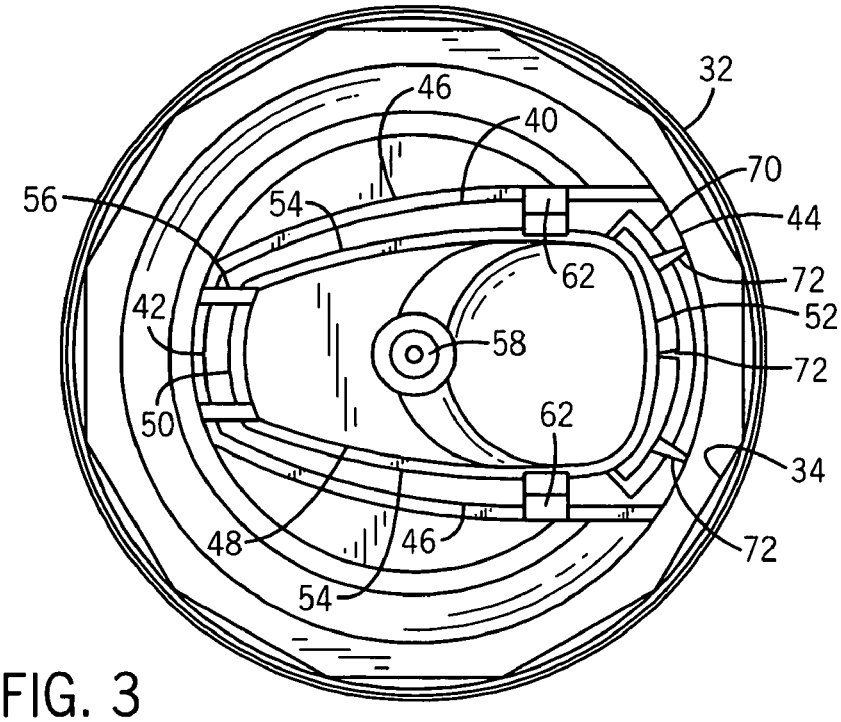
FIG. 3 is a bottom plan view of the actuator cap of FIG. 1.
Figure 4:
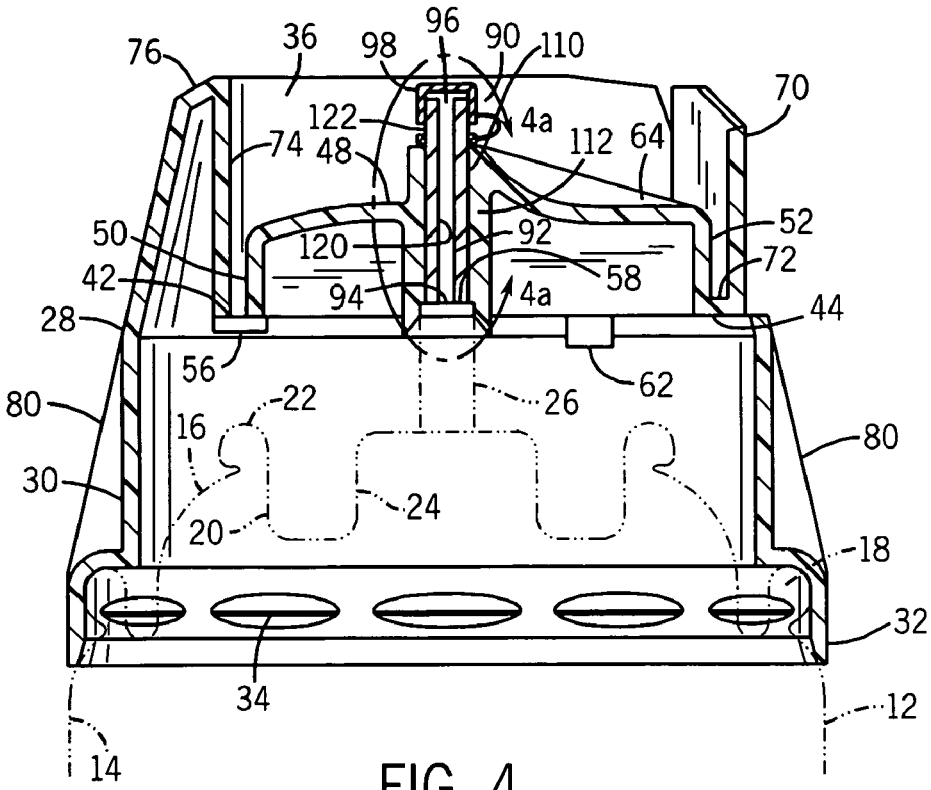
FIG. 4 is a cross-sectional view taken along section lines 4—4 of FIG. 2.

The trigger 48 further includes a downwardly open stem socket 58, as shown in FIGS. 3 and 4. The stem socket 58 is adapted to receive the valve stem 26 and is in fluid communication with conduit 92. The trigger 48, when moved downwardly, activates the release valve 24 by exerting pressure on the valve stem 26, which then engages the time delay system 90 to release the content of the container 12 in a time delayed fashion through conduit 92 via valve stem adapter/stem socket 58.

There also may be a latch 62 that preferably is elastically deformable. The latch 62 is attached to one of a side 46 of the trigger port 40 and a side 54 of the trigger 48. The latch 62 is adapted to engage the other of the side 46 of the trigger port 40 and the side 54 of the trigger 48 when the trigger is in a depressed, valve-activating position to retain the trigger in that position. When in the valve-activating position, the trigger 48 moves the valve stem 26 sufficiently to activate the release valve 24.

Figure 5:
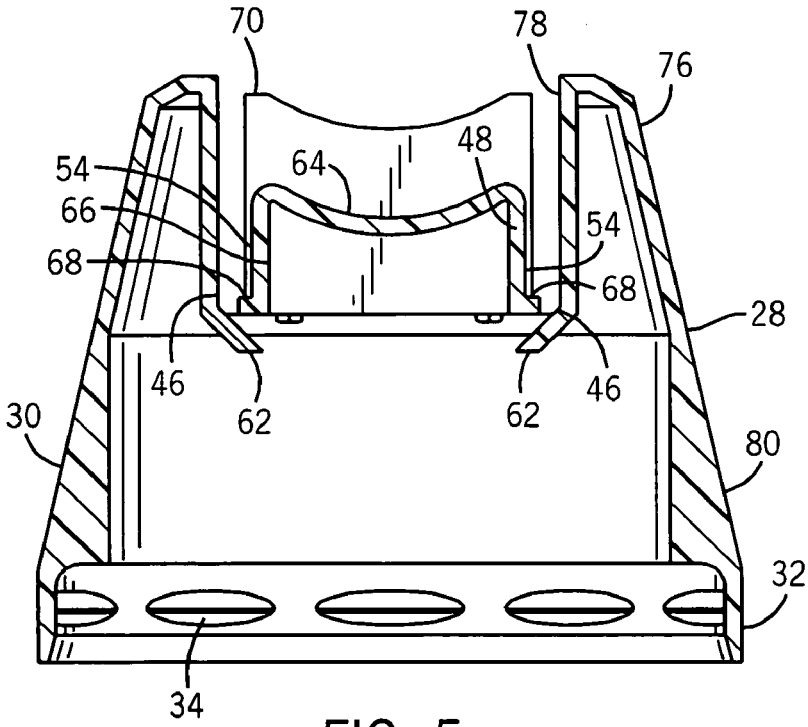
FIG. 5 is a cross-sectional view taken along section lines 5—5 of FIG. 2.
Figure 4A:
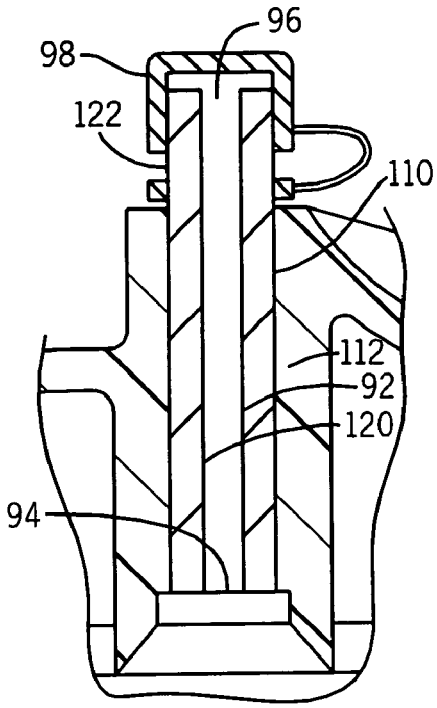
FIG. 4*a* is an enlarged view of the time delay system in FIG. 4.

It is preferred that the latch 62 is attached to a side 46 of the trigger port 40, and that before the time delay actuator assembly 10 is activated, the latch 62 extends laterally under the trigger 48, as is best seen in FIGS. 3 and 5. In this embodiment, when the trigger 48 is depressed by a user, the latch 62 first flexes sidewardly, allowing the trigger 48 to pass downwardly beyond the latch to the valve-activating position. When the trigger 48 has reached the valve-activating position, the latch 62 then springs back over the trigger to retain the trigger in the valve-activating position.

Preferably, the time delay actuator assembly 10 includes two latches 62. In the preferred embodiment shown in the figures, one latch 62 extends from each of the opposed sides 46 of the trigger port 40, although location of the latches on opposed sides 54 of the trigger 48 is also possible. By this means, the two latches 62 retain the trigger 48 under and between the latches when a user has depressed the trigger downwardly between them to the valve-activating position. This arrangement, in combination with other features of the time delay actuator assembly 10 discussed below, leads to a more reliable and trouble-free retention of the trigger 48 when the actuator is used.

Preferably the latch 62 is located beneath the level of the well floor 38. Preferably the trigger 48 includes a push pad 64 on which a user can push to depress the trigger. The push pad 64 may be a surface specially shaped to comfortably receive the user's finger without slipping off the trigger 48, as is the push pad shown in the figures. The trigger 48 preferably also includes a downwardly extended drop side 66. The drop side 66 has an upwardly presented lug 68, the drop side and lug being best shown in FIG. 5. The lug 68 moves beneath and then engages the latch 62 when the trigger 48 is depressed to the valve-activating position. The latch 62 is located sufficiently far beneath the well floor 38 that the trigger 48 reaches its valve-activating position before the finger of a user, pressing on the push pad 64 has the opportunity to contact the latch.

Preferably the actuator assembly 10 includes a tear tab 70 that is unitarily molded with the trigger 48 and the actuator body 28. The tear tab 70 is attached by attachment members 72 to both the end of the trigger 48 that is remote from the hinge 56 and the end of the trigger port 40 remote from the hinge. Thus, when the hinge 56 is located at the front end 42 of the trigger port 40, the tear tab 70 is located at the back end 44 of the trigger port.

The tear tab 70 and attachment members 72 are of a robustness and strength such that the tear tab stabilizes the trigger 48 while the tear tab is in place, reducing the chance of premature activation. However, when a user intentionally and forcibly moves the tear tab 70, the attachment members 72 break, allowing the tear tab to be removed and leaving the trigger 48 free to be depressed. The tear tab 72 and attachment members 72 are best shown in FIGS. 2–4.

Preferably the attachment members 72 are shaped so as to break preferentially at a point remote from the tear tab 70 and immediately adjacent to the remaining structure to which they are attached, be it the trigger 48 or the adjacent surface of the trigger port 40. This arrangement causes the attachment members 72, when the tear tab 70 is torn away, to break free from the trigger 48 and adjacent surface of the trigger port 40 and remain attached to the tear tab. This arrangement leaves the trigger 48 and trigger port 40 free of any remnant of an attachment member 72 that might otherwise be unsightly or uncomfortable to the finger.

Preferably, the peripheral skirt 30 extends upwardly beyond the level of the well floor 38, and a well wall 74 extends upwardly from the outer margins of the well floor. The well wall 74 is best illustrated in FIGS. 1, 2, and 4. The well wall 74 is joined to the upper margin of the peripheral skirt 30 to form a double-walled, hollow bracing structure 76, best illustrated in FIG. 4. The bracing structure 76 extends peripherally around the central well 36, preferably for at least half and more preferably for at least ¾ of its circumference. Preferably a finger gap 78 is left as an opening in the bracing structure 76 to allow a user easy access to the push pad 64. The tear tab 70 may be designed to substantially fill the finger gap 78, further reducing the likelihood of accidental premature activation prior to removal of the tear tab.

The bracing structure 76, well floor 38, and chime-engaging skirt rim 32 all coact to achieve a rigidity with respect to lateral compression that, taken together with the side location of the latches 62, is important to the successful operation of the actuator assembly 10. In a preferred embodiment, a multiplicity of vertical side braces 80 extend upwardly from the skirt rim 32 toward the level of the well floor 38, the side braces 80 projecting radially from the lower part of the peripheral skirt 30. Preferably, the side braces 80 rise from a brace floor 82 formed in the skirt 30, the brace floor preferably resting upon the container chime 18 when the actuator assembly 10 is in place upon the container 12. The brace floor 82 preferably is substantially horizontal and in any event is less than vertical. The side braces 80 and adjacent portions of the peripheral skirt 30 effectively transmit the rigidity of the chime-stabilized skirt rim 32 to the lower portion of the bracing structure 76. The interaction of the brace floor 82 and side braces 80, in conjunction with the remaining adjacent portions of the peripheral skirt 30, also specifically strengthen the lower part of the actuator body 28 in such a manner as to resist both lateral forces and top loading applied to the actuator body 28.

It will be apparent that the side placement of the latches 62, the use of two instead of merely one latch, the bracing structure 76, well floor 38, chime-engaged skirt rim 32, and side braces 80 each individually contribute to a reliable engagement of the trigger 48 by the latches, features that are equally effective if the latches are attached to the sides of the trigger 48 and hook under or otherwise engage the well floor or other parts of the body 28 of the actuator assembly 10.

In accordance with the present invention a first embodiment of our time delay system 90 is connected to the valve stem 26 through a valve stem adapter 58 (FIG. 4), which is also configured to serve as the open stem socket as described below. The time delay system 90 has a conduit 92 with an inlet end 94 and an outlet end 96. The conduit 92 is housed in a conduit well 110 of a trigger 48 as described below.

Figure 6A:
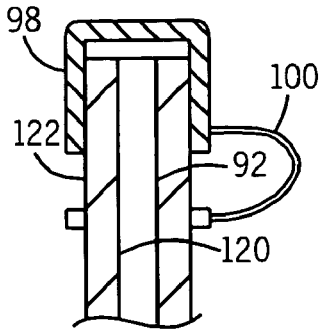
FIGS. 6*a–c* illustrate schematically how features of one embodiment of the present invention work together to provide a timed delay.
Figure 6B:
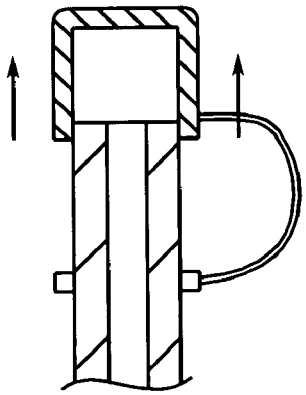
Figure 6C:
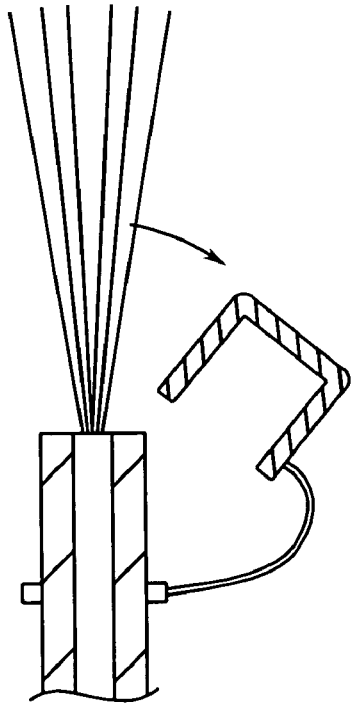

In certain embodiments, conduit 92 and trigger 48 are made of the same material and thus can form a single structural unit. The inlet end 94 is secured to the valve stem adapter 58 and in fluid communication with the release valve 24. The outlet end 96 is sealed by a cap 98 which can move over the outside wall 122 of the conduit with friction. When the actuator is activated as describe below to open up the release valve 24, an open passage way is formed from the inside of the container, through valve stem 26 and conduit 92, to cap 98. As a result, the propellant/active mix from the inside of the container drives cap 98 to move upward (FIGS. 6*a–c*) by overcoming the friction between the cap and the outside wall of the conduit. The cap pops open under the pressure and the content of the container is released to the ambient environment. Cap 98 is secured to the outside wall of the conduit through a connection stem 100 so that it does not become free-flying upon being blown off the conduit.

Figure 7:
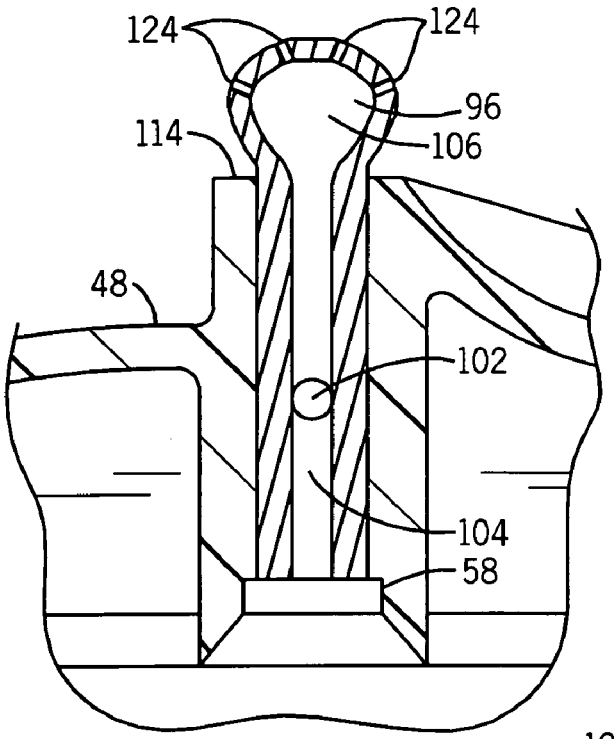
FIG. 7 is a view similar to FIG. 4*a*, albeit of another embodiment.

FIG. 7 shows another embodiment of the time delay system. A ball shaped plug 102 is employed as the sealing member for conduit 92, which is configured to have a narrow seal portion 104 where the plug 102 can be placed to seal the conduit and a wide catching portion 106. The plug can move through the inside wall 120 of a passage of the conduit with friction. Upon activation of the release valve 24, the pressure from the inside of the container drives the plug to move it upward from the seal portion to the catching portion, at which point the container content bypasses the plug to exit to ambient environment via narrow opens 124 at the outlet end of the conduit.

Figure 8:
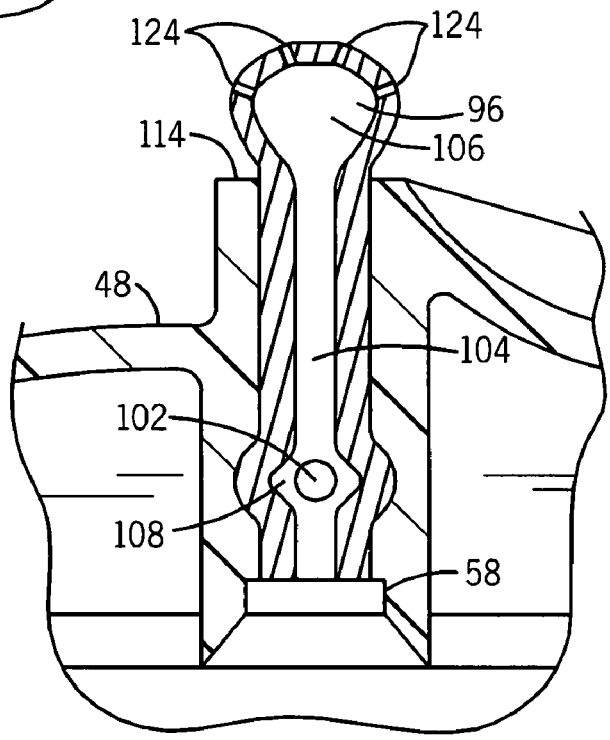
FIG. 8 is similar to FIG. 4*a*, except of yet another embodiment.
Figure 9:
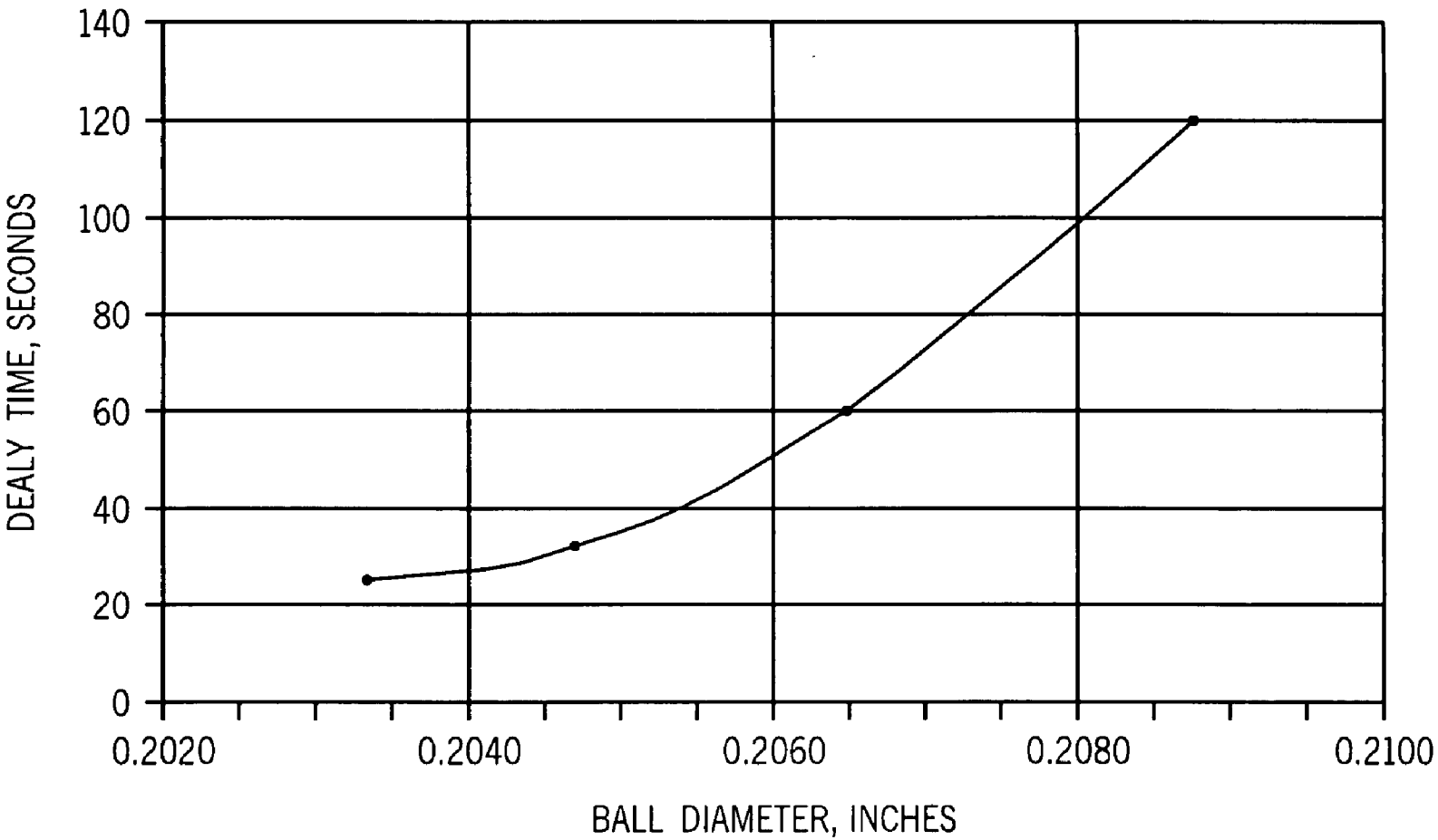
FIG. 9 shows in graph form how the time delay duration can be altered by changing the diameter of the plug.

In another preferred embodiment, conduit 92 further has a wide pocket portion 108 where the plug is typically placed (FIG. 8). Upon activation of the release valve 24, the container pressure essentially immediately pushes the plug into the narrow seal portion of the conduit and further drives the plug to move it from the seal portion to the catching portion after a predetermined period time. Since the plug is not in pressing fit to the inside wall 120 of the conduit while sitting in pocket 108, this arrangement avoids the potential risk of time delay system malfunction due to mechanical freezing during storage.

The above systems can provide for total release of the contents of an aerosol container 12 with only an initial manual intervention. Upon depressing trigger 48 by manual pressure until the latch 62 engages the trigger to retain it in its valve-actuating position, the consumer will then have a defined period to leave before spray begins to exit the device. This can be designed to be 60 seconds or more, but preferably is on the order of 10–30 seconds. Then, the container 12 is left undisturbed until the container's contents are discharged.

The chemical may be dispensed with a single continuous, albeit prolonged, burst. Alternatively, a system such as that shown in U.S. Pat. No. 6,688,492 can be modified to have its outlet converted with a time delay conduit and plug, so as to provide an automatic dispensing valve that iterates between on and off automatically. With such a system multiple segregated bursts could be dispensed, albeit after an initial time delay.

The actuator cap is preferably molded from a plastic material. The actuator assembly conduit may be molded from a plastic, and the plug may be a plastic or a metal. Other materials may also be used.

The above description has been that of preferred embodiments of the present invention. It will occur to those that practice the art, however, that still other modifications may be made without departing from the spirit and scope of the invention. In order to advise the public of the various embodiments that may fall within the scope of the invention, the following claims are made.

INDUSTRIAL APPLICABILITY

The present invention provides actuator assemblies useful for dispensing chemicals from an aerosol container in a time-delayed fashion.

What is claimed is:

1. An actuator assembly suitable for dispensing a chemical from an aerosol container to ambient environment with a time delay after initial activation of the actuator assembly, the actuator assembly comprising:

a release valve linkable to the aerosol container for controlling the release of the chemical from the container to said environment;

an actuator adapted to mount on the aerosol container and be operably connected to the release valve for at least initially activating the release valve; and a time delay system associated with the release valve which comprises a movable solid plug and a wall contacting the plug;

whereby upon initial activation of the actuator assembly the plug will be caused to move from a sealing position to an unsealing position, with friction between the plug and wall regulating the speed of such movement so as to thereby create said time delay, whereby at the unsealing position the plug loses frictional contact with the wall by virtue of having popped open relative to the wall or by virtue of having passed into an enlarged catching section associated with the wall.

2. The actuator assembly of claim 1, wherein the wall is an exterior wall of a conduit and the plug is in the form of a cap mountable outside and against an end of the conduit.

3. The actuator assembly of claim 2, wherein the plug is linked by a flexible tether to the conduit.

4. The actuator assembly of claim 1, wherein the wall is an interior wall of a passage and said plug is in the form of a ball positioned inside the passage to move along the passage.

5. The actuator assembly of claim 4, wherein the plug can frictionally engage the wall as it moves along the passage.

6. The actuator assembly of claim 5, wherein one of the wall and the plug is made of metal, and one of the wall and the plug is made of plastic.

7. The actuator assembly of claim 4, wherein the passage has the enlarged catching section positioned adjacent an end of the passage.

8. The actuator assembly of claim 7, wherein the passage has an enlarged interior rest area upstream of the catching section.

9. The actuator assembly of claim 1, wherein upon initial activation the actuator assembly can dispense essentially all of the chemical in the container without further outside manual intervention.

10. The actuator assembly of claim 1, wherein upon initial activation the actuator assembly can dispense essentially all of the chemical in the container without further outside manual intervention, in a continuous single burst.

11. The actuator assembly of claim 1, wherein the wall is part of a passage and the plug and wall are configured such that the plug can move from a first position in which the plug blocks dispensing of the chemical from the container to a second position in which the plug is retained by the actuator assembly but does not block dispensing of the chemical from the container.

12. The actuator assembly of claim 1, wherein the plug is made of a flexible material and the wall is made of a material that is less flexible than the material that the plug is made of.

13. The actuator assembly of claim 1, wherein the wall is made of a flexible material and the plug is made of a material that is less flexible than the material that the wall is made of.

14. The actuator assembly of claim 1, wherein a time delay between initial activation of the release valve and the first exit of chemical to said environment from the container as a result thereof is at least 10 seconds.

15. The actuator assembly of claim 1, wherein a time delay between initial activation of the release valve and the first exit of chemical to said environment from the container as a result thereof is at least 60 seconds.

16. An actuator assembly suitable for dispensing a chemical from an aerosol container to ambient environment, with a time delay after initial activation of the actuator assembly, the actuator assembly comprising:

a release valve linkable to the aerosol container for controlling the release of the chemical from the container to said environment;

an actuator adapted to mount on the aerosol container and be operably connected to the release valve for at least initially activating the release valve; and a time delay system associated with the release valve which comprises a movable solid plug and a wall contacting the plug;

whereby upon initial activation of the actuator assembly the plug will be caused to move from a sealing position to an unsealing position, with friction between the plug and wall regulating the speed of such movement so as to thereby create said time delay;

wherein the wall is an interior wall of a passage and said plug is positioned inside the passage to move along the passage.

* * * * *